US011969089B2

(12) United States Patent
Chen et al.

(10) Patent No.: US 11,969,089 B2
(45) Date of Patent: Apr. 30, 2024

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Wei-Chen Chang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 151 days.

(21) Appl. No.: 17/542,513

(22) Filed: Dec. 6, 2021

(65) Prior Publication Data

US 2023/0099003 A1 Mar. 30, 2023

(30) Foreign Application Priority Data

Sep. 29, 2021 (TW) ..... 110136621

(51) Int. Cl.
*A47B 88/487* (2017.01)
*A47B 88/43* (2017.01)

(52) U.S. Cl.
CPC ..... *A47B 88/487* (2017.01); *A47B 88/43* (2017.01)

(58) Field of Classification Search
CPC ..... A47B 88/43; A47B 88/487; A47B 88/493; A47B 88/477; A47B 2210/0043; A47B 2210/0008; H05K 7/1489; H05K 7/183
See application file for complete search history.

(56) References Cited

U.S. PATENT DOCUMENTS

| | | | | |
|---|---|---|---|---|
| 6,655,763 | B2 * | 12/2003 | Judge | A47B 88/493 312/334.46 |
| 7,090,319 | B2 * | 8/2006 | Milligan | A47B 88/57 312/334.44 |
| 7,178,888 | B2 * | 2/2007 | Judge | A47B 88/493 312/334.44 |
| 7,780,254 | B2 * | 8/2010 | Wang | A47B 88/483 312/334.44 |
| 8,752,917 | B1 * | 6/2014 | Chang | A47B 88/487 312/334.47 |
| 8,757,614 | B2 | 6/2014 | Okamoto | |
| 8,780,565 | B2 | 7/2014 | Henderson | |
| 9,545,153 | B2 | 1/2017 | Chen | |
| 9,894,994 | B2 * | 2/2018 | Raid | A47B 88/493 |
| 10,213,017 | B2 | 2/2019 | Chen | |
| 10,260,556 | B2 | 4/2019 | Chen et al. | |
| 10,463,149 | B1 * | 11/2019 | Chen | A47B 88/473 |

(Continued)

FOREIGN PATENT DOCUMENTS

| | | | | |
|---|---|---|---|---|
| DE | 19519448 | B4 * | 7/2005 | A47B 88/493 |
| EP | 4 101 342 | A1 | 12/2022 | |

(Continued)

*Primary Examiner* — Patrick D Hawn
(74) *Attorney, Agent, or Firm* — Winston Hsu

(57) ABSTRACT

A slide rail assembly includes a first rail, a second rail, and an auxiliary member. The first rail includes a passage, and the passage includes a passage opening. The second rail is inserts in the passage from the passage opening through being guided by the auxiliary member.

20 Claims, 10 Drawing Sheets

(56) References Cited

U.S. PATENT DOCUMENTS

| | | | | |
|---|---|---|---|---|
| 10,694,847 | B2 | 6/2020 | Chen | |
| 10,806,256 | B1 | 10/2020 | Chen | |
| 11,452,375 | B2 * | 9/2022 | Chen | A47B 88/49 |
| 11,583,078 | B2 * | 2/2023 | Moscoso | A47B 88/477 |
| 2013/0156476 | A1 * | 6/2013 | Yokoyama | G03G 15/6529 399/361 |
| 2013/0259411 | A1 * | 10/2013 | Judge | F16C 29/04 384/49 |
| 2013/0334766 | A1 | 12/2013 | Okamoto | |
| 2013/0334949 | A1 * | 12/2013 | Yokoyama | B65H 1/266 271/145 |
| 2015/0366346 | A1 | 12/2015 | Raid | |
| 2022/0395095 | A1 * | 12/2022 | Chen | A47B 88/477 |

FOREIGN PATENT DOCUMENTS

| | | | |
|---|---|---|---|
| JP | 2013-255678 | A | 12/2013 |
| JP | 3200963 | U | 11/2015 |
| JP | 2018-57812 | A | 4/2018 |
| JP | 2020-11032 | A | 1/2020 |
| JP | 2020-185369 | A | 11/2020 |
| TW | 200843625 | | 11/2008 |

* cited by examiner

SLIDE RAIL ASSEMBLY

BACKGROUND OF THE INVENTION

1. Field of the Invention

The present invention relates to a slide rail assembly, and more particular, to a slide rail assembly that is convenient for a rail to reinsert and to be guided in another rail, after the rail is drawn from the another rail.

2. Description of the Prior Art

U.S. Pat. No. 10,260,556 B2 discloses a rail assembly that facilitates mounting a slide rail to another slide rail. The slide rail includes a first rail and a second rail. The first rail includes a first wall, a second wall, and a longitudinal wall connected between the first wall and the second wall. The first wall, the second wall, and the longitudinal wall jointly define a passage. A guiding structure is positioned adjacent to a passage opening of the passage, such that the second rail is mounted in the passage from the passage opening through being guided by the guiding structure.

Although the above-mentioned patent has disclosed related technical features that facilitate mounting a slide rail to another slide rail, with different demands of the market, developing a different slide rail product has become an important issue.

SUMMARY OF THE INVENTION

The present invention provides a slide rail assembly which is convenient for a rail to reinsert and to be guided in another rail, after the rail is drawn from the another rail.

According to one aspect of the present invention, a slide rail assembly includes a first rail, a second rail, and an auxiliary member. The first rail includes a first end portion, a second end portion, and a passage positioned between the first end portion and the second end portion of the first rail, and the passage of the first rail includes a passage opening. The auxiliary member is arranged adjacent to the passage opening of the first rail, and the auxiliary member includes an arced contour. The second rail is inserted in the passage of the first rail from the passage opening of the first rail through being guided by the arced contour of the auxiliary member.

Preferably, the auxiliary member is arranged on the first rail.

Preferably, the auxiliary member is arranged on the first rail via a connecting member.

Preferably, the connecting member is connected to the first rail.

Preferably, the auxiliary member is a roller or a ball.

Preferably, the first rail includes a first wall, a second wall, and a longitudinal wall connected between the first wall and the second wall. The first wall, the second wall, and the longitudinal wall jointly define the passage.

Preferably, the slide rail assembly further includes a third rail, and the first rail is movably mounted between the third rail and the second rail.

Preferably, the slide rail assembly further includes a reinforcement member and a first bracket device. The reinforcement member is connected to the third rail and exceeds a first end portion of the third rail. The first bracket device is configured on the reinforcement member, and the first bracket device is configured for providing a first post for the third rail to be mounted on a rack.

Preferably, the slide rail assembly further includes a supporting member arranged on the first rail via the connecting member. The supporting member includes an arced contour. When the first rail is moved relative to the third rail, the first rail is in contact with the reinforcement member via the arced contour of the supporting member.

Preferably, the supporting member is a roller or a ball.

Preferably, the reinforcement member includes a first portion, a second portion, and a longitudinal portion connected between the first portion and the second portion. The connecting member includes a holding structure corresponding to one of the first portion and the second portion of the reinforcement member.

Preferably, the slide rail assembly further includes a second bracket device movable relative to the third rail. The second bracket device is configured for providing a second post for the third rail to be mounted on the rack.

Preferably, the slide rail assembly further includes a slide assisting device movably mounted in the passage of the first rail and a first blocking portion and a second blocking portion arranged in the passage of the first rail. The first blocking portion and the second blocking portion are respectively adjacent to the first wall and the second wall of the first rail, so as to operate cooperatively with the slide assisting device.

According to another aspect of the present invention, a slide rail assembly includes a first rail, a second rail, and an auxiliary member. The first rail includes a passage. The auxiliary member is arranged adjacent to a passage opening of the first rail. The auxiliary member includes a roller with an arced contour. When the second rail is being mounted inside of the passage of the first rail from outside of the passage of the first rail, the second rail is supported by the auxiliary member, and when the second rail is moved in a retracting direction, the second rail is inserted in the passage of the first rail from the passage opening of the first rail through being guided by the arced contour of the roller of the first rail.

Preferably, the auxiliary member is arranged on the first rail via a connecting member, and the connecting member is connected to the first rail.

Preferably, the slide rail assembly further includes a third rail. The first rail is movably mounted between the third rail and the second rail, and a reinforcement member is connected to the third rail and exceeds a first end portion of the third rail.

Preferably, the slide rail assembly further includes a supporting member arranged on the first rail via the connecting member. The supporting member includes an arced contour. When the first rail is moved relative to the third rail, the first rail is in contact with the reinforcement member via the arced contour of the supporting member. The reinforcement member includes a first portion, a second portion, and a longitudinal portion connected between the first portion and the second portion. The connecting member includes a holding structure corresponding to one of the first portion and the second portion.

According to yet another aspect of the present invention, a slide rail assembly includes a first rail including a passage, a second rail, and an auxiliary member. The auxiliary member is arranged adjacent to a passage opening of the first rail, and the auxiliary member is one of a roller or a ball. The second rail is inserted in the passage of the first rail from the passage opening of the first rail through being guided by the auxiliary member.

Preferably, the slide rail assembly further includes a third rail and a reinforcement member. The first rail is movably mounted between the third rail and the second rail, and the reinforcement member is connected to the third rail and exceeds a first end portion of the third rail.

Preferably, the slide rail assembly further includes a supporting member arranged on the first rail. The supporting member includes an arced contour. When the first rail is moved relative to the third rail, the first rail is in contact with the reinforcement member via the arced contour of the supporting member.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
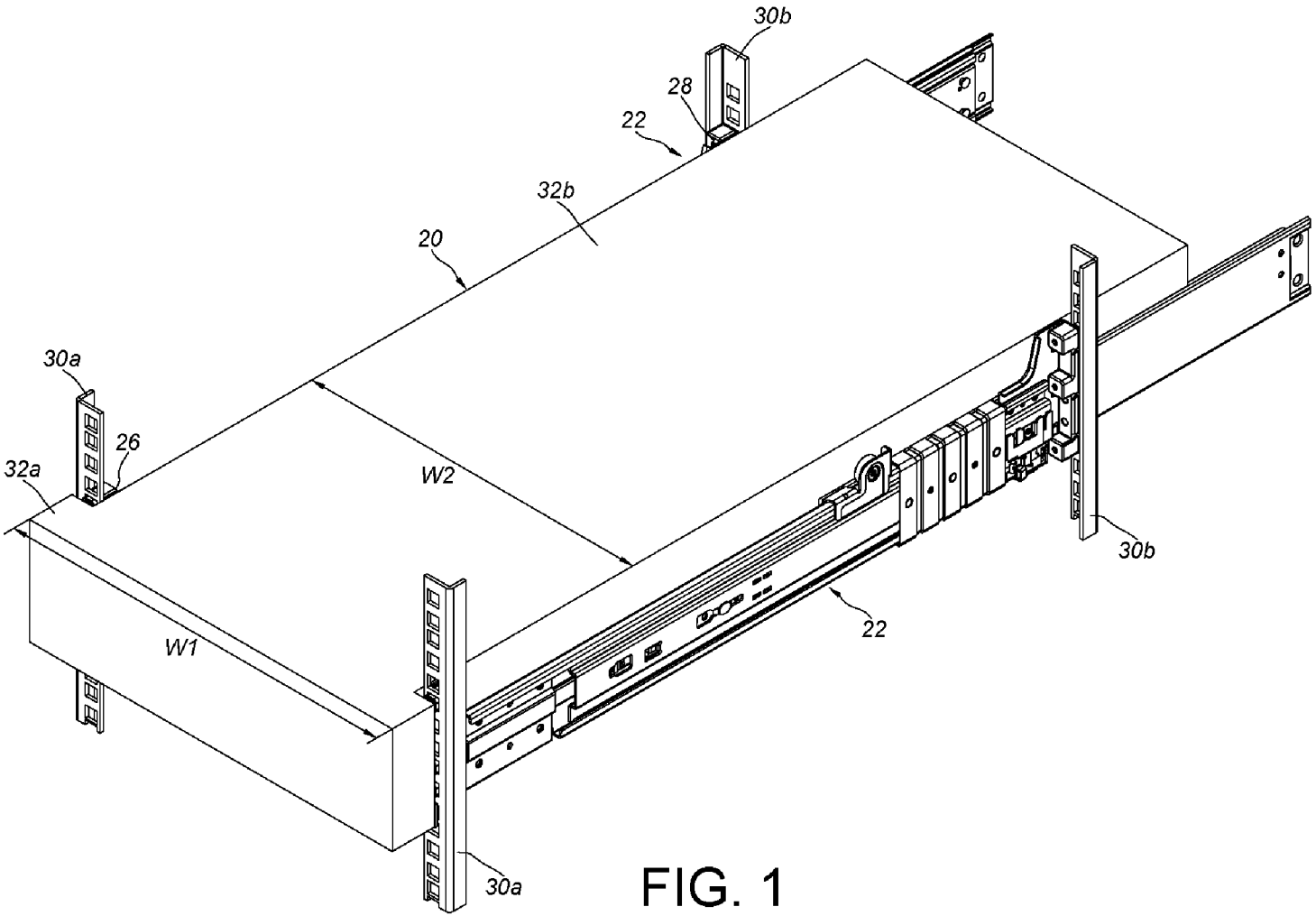
FIG. 1 is a schematic perspective view of an object being able to be mounted to a chassis via a slide rail assembly according to an embodiment of the present invention.
Figure 2:
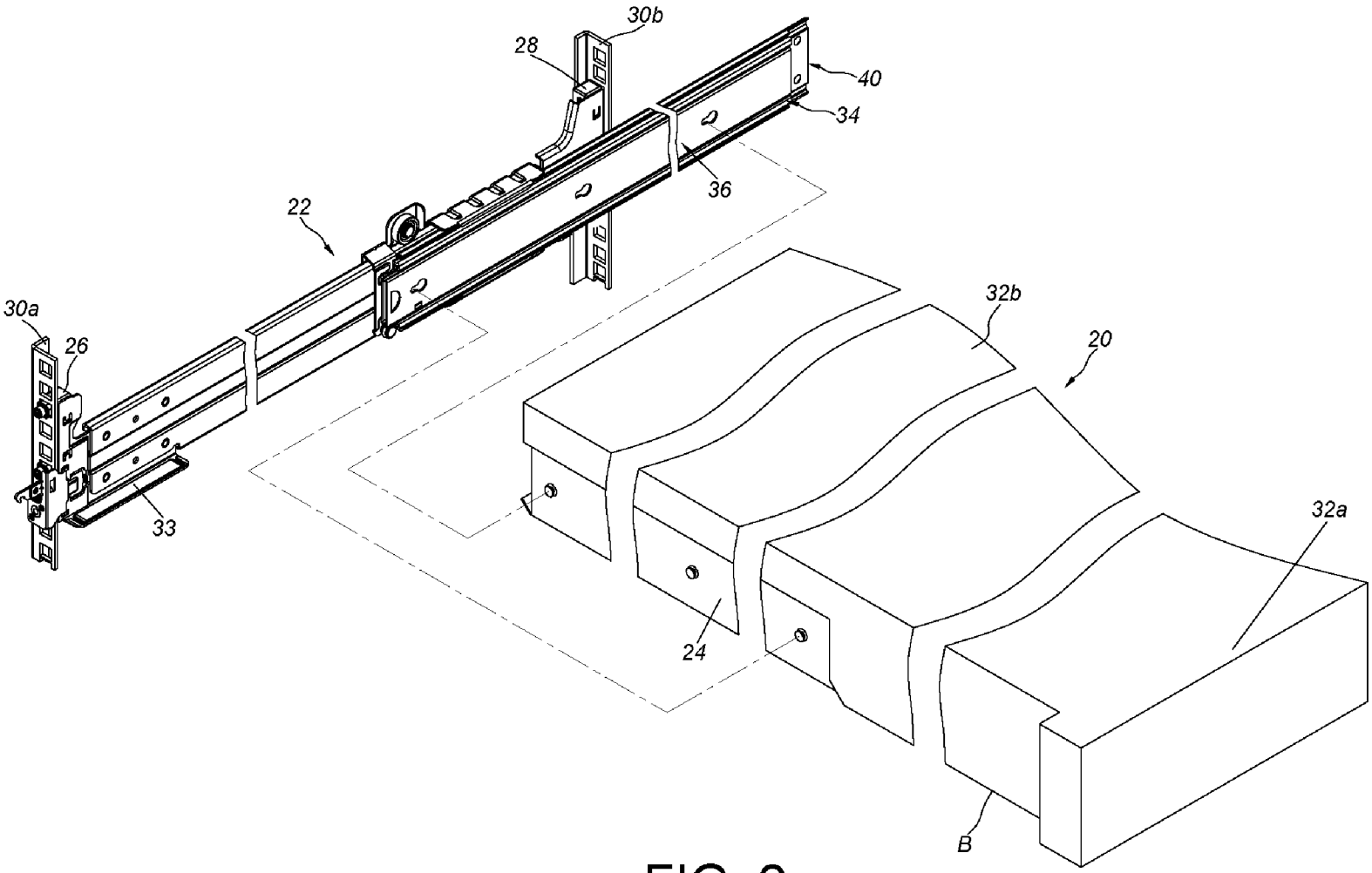
FIG. 2 is a schematic exploded view of the object and the slide rail assembly mounted to the chassis according to an embodiment of the present invention.

As shown in FIG. 1 and FIG. 2, an object 20 can be mounted to a rack through a pair of slide rail assemblies 22 according to an embodiment of the present invention. The pair of slide rail assemblies 22 has substantially the same structural configuration. Each of the slide rail assemblies 22 is arranged on one side 24 of the object 20, and each of the slide rail assemblies 22 can be mounted on a first post 30*a* and a second post 30*b* of the rack via a first bracket device 26 and a second bracket device 28, respectively. In this embodiment, the object 20 is an electronic device or a chassis with a specific structure. For example, the object 20 has a head portion 32*a* and a body portion 32*b* connected to the head portion 32*a*. The head portion 32*a* has a first width W1 that is wider than a second width W2 of the body portion 32*b*. However, as long as the object 20 can be mounted to the rack, the specific structure is not limited in the present invention. Since the object 20 has the specific structure, each of the slide rail assemblies 22 can be correspondingly mounted on the side 24 of the body portion 32*b* of the object 20. When the slide rail assembly 22 (each of the slide rail assemblies) is in a retracted state, the head portion 32*a* of the object 20 exceeds the first post 30*a* and is positioned outside the rack. Preferably, the slide rail assembly 22 includes a supporting portion 33 for supporting a bottom portion B of the object 20.

Figure 3:
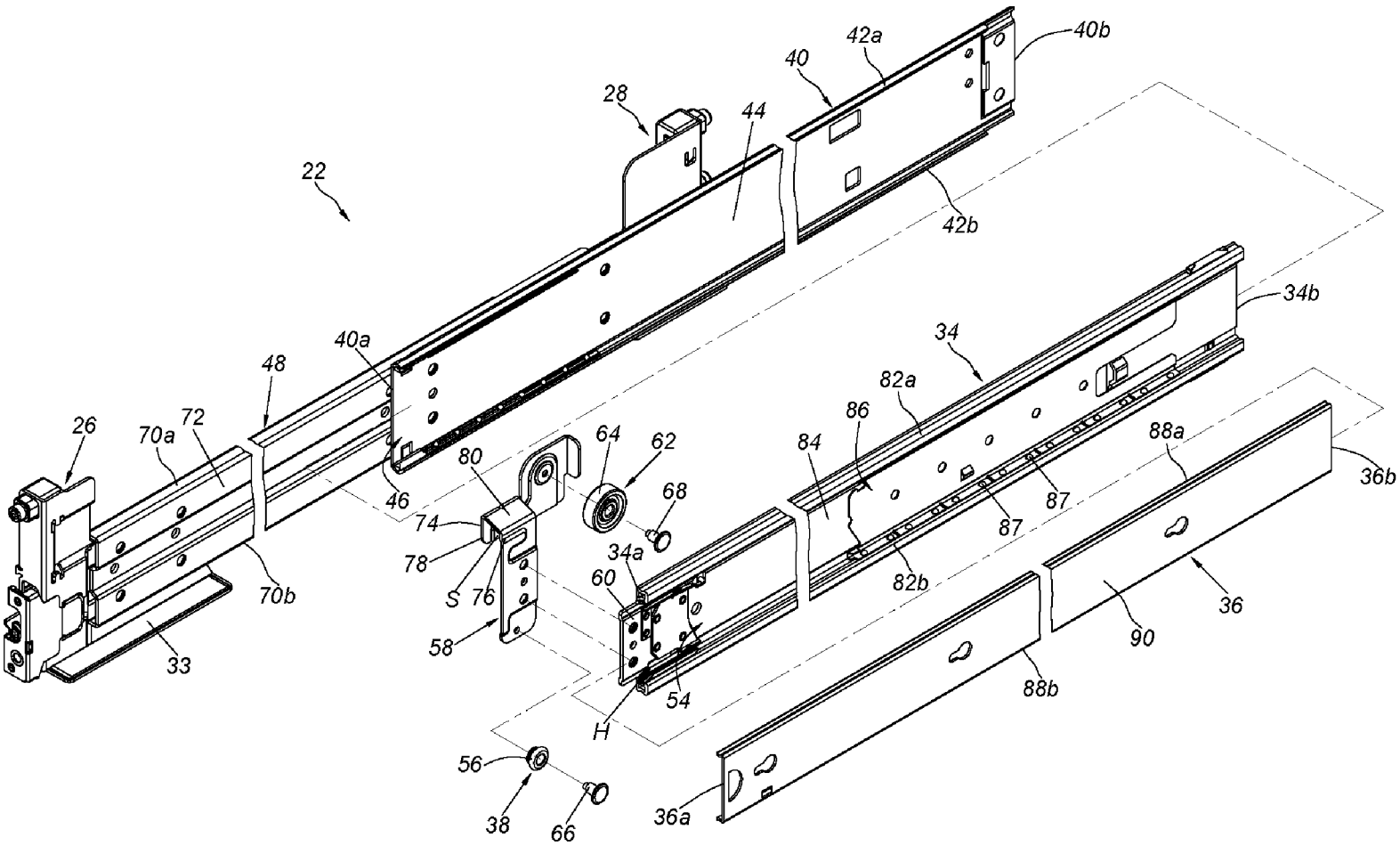
FIG. 3 is a schematic exploded perspective view of the slide rail assembly including a first rail, a second rail, and a third rail according to an embodiment of the present invention.
Figure 4:
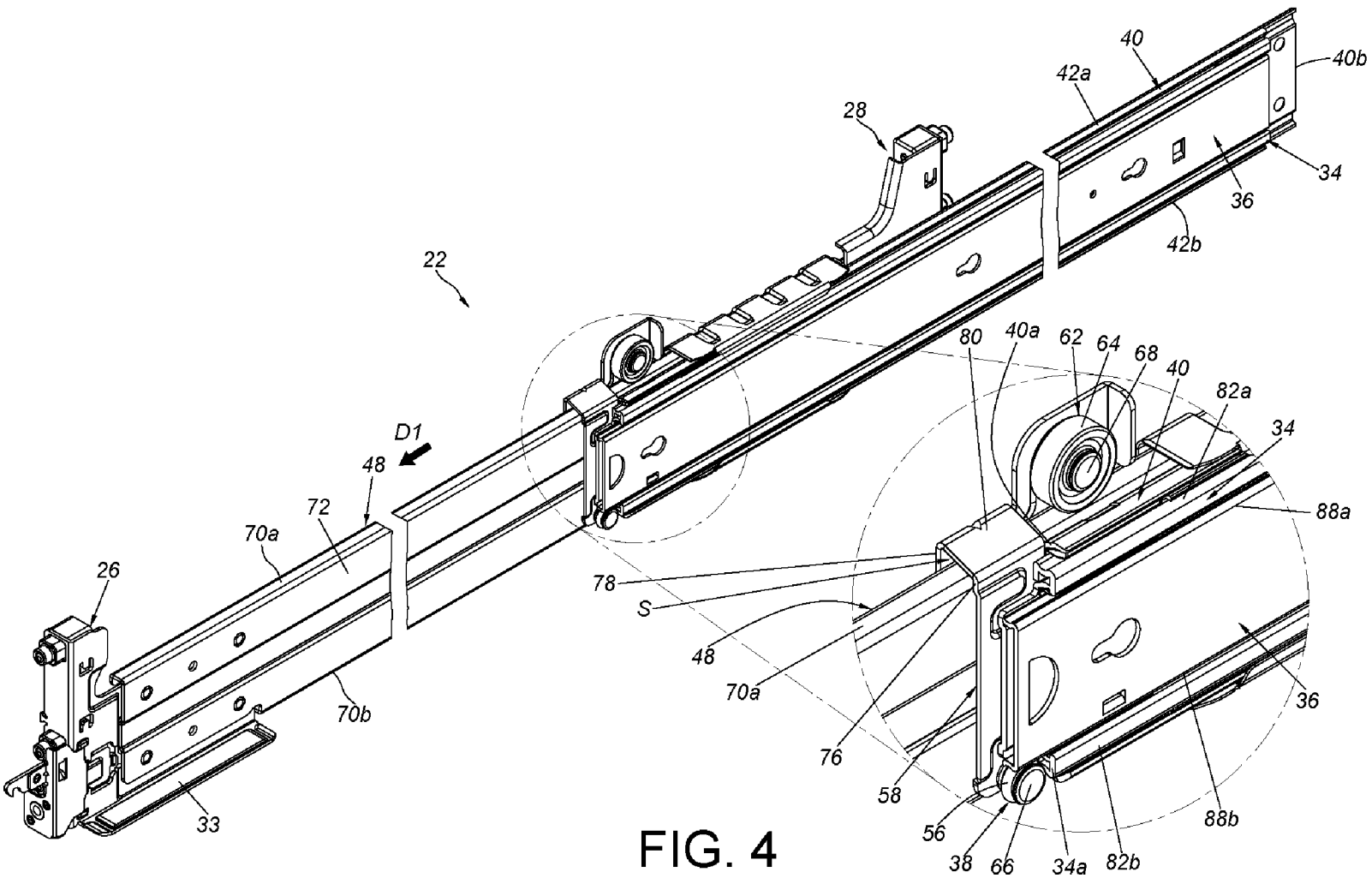
FIG. 4 is a schematic assembled view of the slide rail assembly from a perspective according to an embodiment of the present invention.
Figure 5:
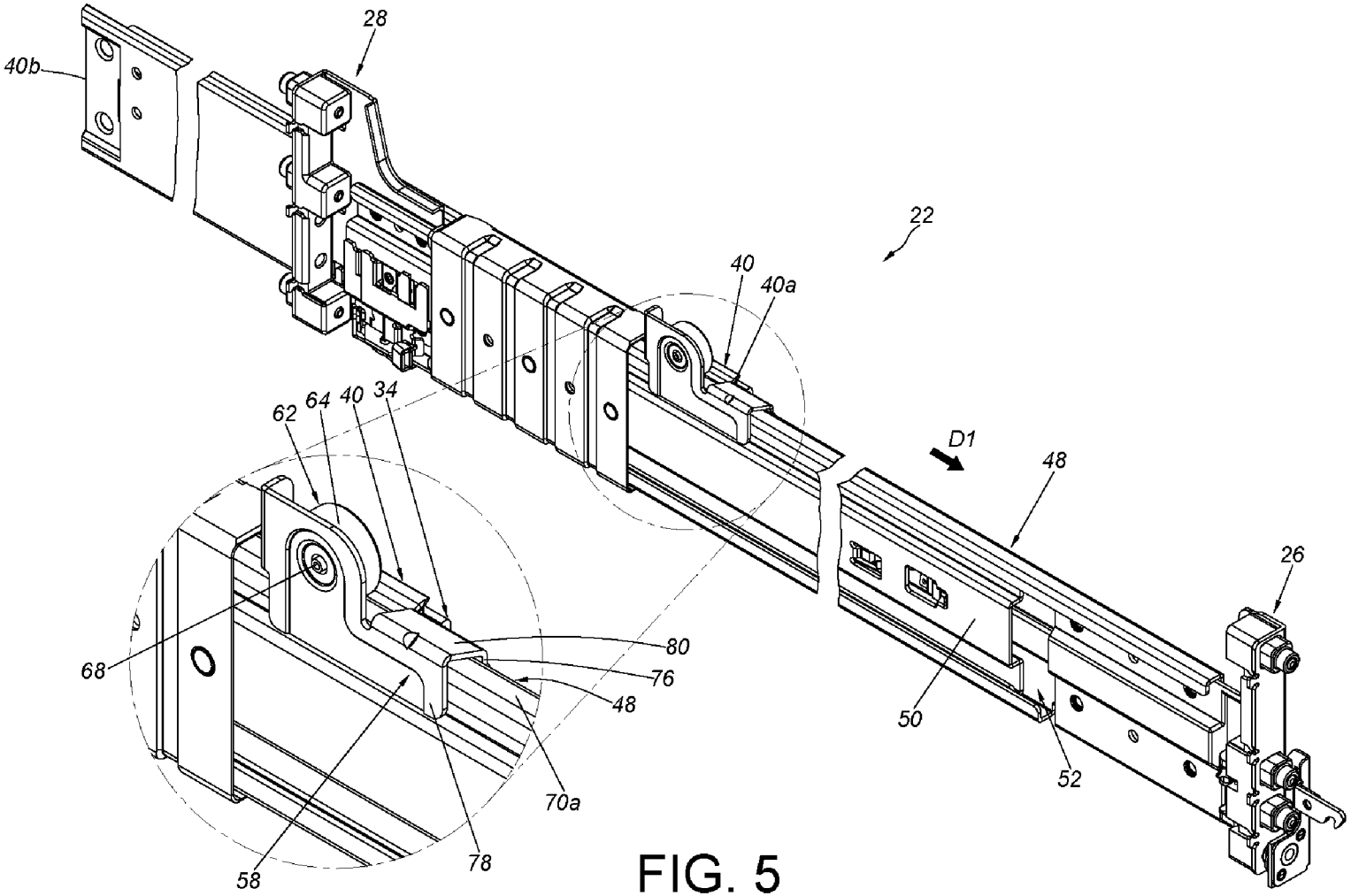
FIG. 5 is another schematic assembled view of the slide rail assembly from another perspective according to an embodiment of the present invention.

As shown in FIG. 3 to FIG. 5, the slide rail assembly 22 includes a first rail 34, a second rail 36, and an auxiliary member 38. Preferably, the slide rail assembly 22 further includes a third rail 40, and the first rail 34 (e.g., a middle rail) is movably mounted between the third rail 40 (e.g., an outer rail) and the second rail 36 (e.g., an inner rail). The first rail 34 can be configured to extend a moving distance of the second rail 36 relative to the third rail 40.

The third rail 40 includes a first wall 42*a*, a second wall 42*b*, and a longitudinal wall 44 connected between the first wall 42*a* and the second wall 42*b* of the third rail 40. The first wall 42*a*, the second wall 42*b*, and the longitudinal wall 44 of the third rail 40 jointly define a passage 46. The third rail 40 has a first end 40*a* and a second end 40*b*, and the passage 46 is positioned between the first end 40*a* and the second end 40*b*.

Preferably, the slide rail assembly 22 further includes a reinforcement member 48 connected (e.g., fixedly attached, but not limited) to the third rail 40, and a portion of the reinforcement member 48 exceeds the first end 40*a* of the third rail 40, the first bracket device 26 is configured (e.g., fixedly attached, but not limited) to the portion of the reinforcement member 48 exceeding the first end 40*a* of the third rail 40.

Preferably, the second bracket device 28 can be moved relative to the third rail 40. For example, the second bracket device 28 can be movably mounted to a reinforcement passage 52 of the reinforcement member 48 (as shown in FIG. 5) via an extension bracket 50, so that the second bracket device 28 can be adjusted or moved relative to the third rail 40. In other words, the second bracket device 28 is movable relative to the first bracket device 26, so that the slide rail assembly 22 can be mounted to racks of different depths (or lengths) via the first bracket device 26 and the second bracket device 28.

The first rail 34 can be movably mounted to the passage 46 of the third rail 40. The first rail 34 has a first end 34*a*, a second end 34*b*, and a passage 54 positioned between the first end 34*a* and the second end 34*b* of the first rail 34, and the passage 54 of the first rail 34 has a passage opening H. The passage opening H is communicated with the passage 54.

The auxiliary member 38 is arranged at the passage opening H adjacent to the first rail 34, and the auxiliary member 38 includes an arced contour 56.

Preferably, the auxiliary member 38 is arranged on the first rail 34. For example, the auxiliary member 38 can be arranged on the first rail 34 via a connecting member 58 which is connected (e.g., fixed attached, but not limited) to the first rail 34 and can be regarded as a portion of the first rail 34.

Preferably, the first rail 34 includes an extension section 60 exceeding the first end 34*a* of the first rail 34 for a predetermined distance, and the connecting member 58 is connected to the extension section 60 of the first rail 34.

Preferably, the auxiliary member 38 is a roller or a ball. The auxiliary member 38 is exemplified as a roller, but the present invention is not limited thereto.

Preferably, the slide rail assembly 22 further includes a supporting member 62 arranged on the first rail 34. For example, the supporting member 62 is arranged on the first rail 34 via the connecting member 58, and the supporting member 62 includes an arced contour 64. The supporting member 62 is a roller or a ball. The supporting member 62 is exemplified as a roller, but the present invention is not limited thereto.

Preferably, the auxiliary member 38 and the supporting member 62 are pivotally connected to the connecting member 58 through a first shaft 66 and a second shaft 68, respectively, and the auxiliary member 38 and the supporting member 62 are positioned in different positions.

Preferably, the reinforcement member 48 has a first portion 70*a*, a second portion 70*b*, and a longitudinal portion 72 connected between the first portion 70*a* and the second portion 70*b*. The connecting member 58 includes a holding structure 74 corresponding to one of the first portion 70*a* and the second portion 70*b* of the reinforcement member 48. For example, the holding structure 74 can be used to support or hold the first portion 70*a* of the reinforcement member 48, which facilitates to enhance stability and structural strength of the connection member 58 being connected to the first rail 34. The holding structure 74 is exemplified to be holding the first portion 70*a* of the reinforcement member 48, but the present invention is not limited thereto. For example, the holding structure 74 includes a first wall section 76, a second wall section 78, and a third wall section 80 that are bent relative to one another. The third wall section 80 is positioned between the first wall section 76 and the second wall section 78. The first wall section 76, the second wall section 78, and the third wall section 80 jointly define a space S, and the first portion 70*a* of the reinforcement member 48 passes through the space S.

Preferably, the first wall section 76, the second wall section 78 and the third wall section 80 of the holding structure 74 are bent perpendicularly to one another.

Preferably, the first rail 34 includes a first wall 82*a*, a second wall 82*b*, and a longitudinal wall 84 connected between the first wall 82*a* and the second wall 82*b* of the first rail 34. The first wall 82*a*, the second wall 82*b* and the longitudinal wall 84 of the first rail 34 jointly define the passage 54, and the second rail 36 can be movably mounted to the passage 54 of the first rail 34.

Preferably, the slide rail assembly 22 further includes a slide assisting device 86 movably mounted in the passage 54 of the first rail 34. The slide assisting device 86 includes a plurality of balls 87, and the balls 87 are configured to assist sliding of the first rail 34, and enhance smoothness of a movement of the second rail 36 relative to the first rail 34.

Preferably, compared to the supporting member 62, the auxiliary member 38 is more adjacent to the second wall 82*b* of the first rail 34, and the auxiliary member 38 exceeds the first end 34*a* of the first rail 34.

The second rail 36 includes a first wall 88*a*, a second wall 88*b*, and a longitudinal wall 90 connected between the first wall 88*a* and the second wall 88*b* of the second rail 36. The second rail 36 has a first end 36*a* and a second end 36*b*.

It is worth mentioning that, as shown in FIG. 4 and FIG. 5, when the first rail 34 is moved relative to the third rail 40 in a direction (e.g., an opening direction D1 or a retracting direction), the first rail 34 can be in contact with the first portion 70*a* of the reinforcement member 48 via the arced contour 64 of the supporting member 62, which facilitates to reduce frictional resistance. For example, the supporting member 62 can roll along a longitudinal direction of the first portion 70*a* of the reinforcement member 48 to reduce the frictional force when the first rail 34 is moved relative to the third rail 40, which facilitates to ensure the smoothness of the movement of the first rail 34 relative to the third rail 40 and allow the first rail 34 (or the second rail 36) to obtain additional supporting effect relative to the third rail 40. For a user, the afore-mentioned configuration can effectively reduce the pulling or pushing force required to be applied to the rails; that is, the user can more easily or more effortlessly complete an opening action or a closing action of the slide rail assembly 20.

Figure 6:
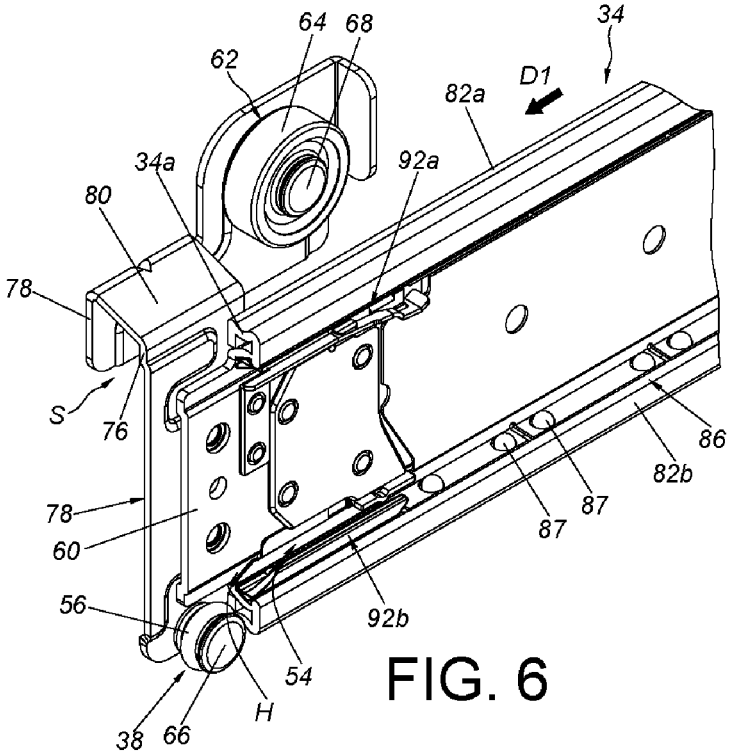
FIG. 6 is a partial perspective schematic view of the first rail of the slide rail assembly according to an embodiment of the present invention.
Figure 7:
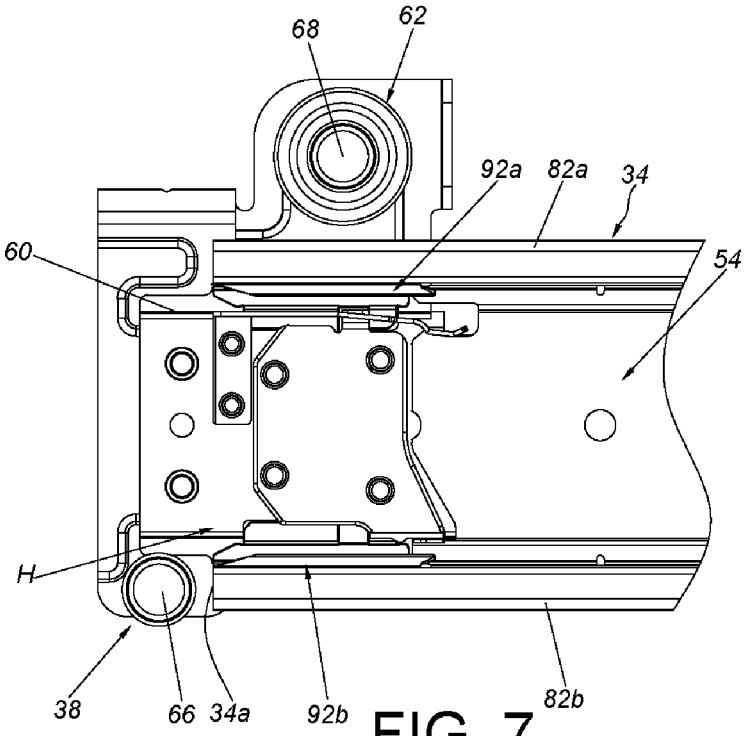
FIG. 7 is a partial schematic view of the second rail of the first rail of the slide rail assembly according to an embodiment of the present invention.

As shown in FIG. 6 and FIG. 7, the first rail 34 further includes a first blocking portion 92*a* and a second blocking portion 92*b* which are arranged in the passage 54 of the first rail 34, and the first blocking portion 92*a* and the second blocking portion 92*b* are respectively adjacent to the first wall 82*a* and the second wall 82*b* of the first rail 34, configured to be used in conjunction with the slide assisting device 86. For example, when the slide assisting device 86 is moved relative to the first rail 34 to a limit position in the passage 54 of the first rail 34, the first blocking portion 92*a* and the second blocking portion 92*b* can block the slide assisting device 86, so as to prevent the slide assisting device 86 from leaving the passage 54 of the first rail 34 in the opening direction D1.

As shown in FIG. 8 to FIG. 11, the third rail 40 is mounted on the first post 30*a* and the second post 30*b* via the first bracket device 26 and the second bracket device 28. On the other hand, the second rail 36 mounted with the object 20 can be disengaged from the passage 54 of the first rail 34 for certain requirements, such as maintenance or replacement.

Figure 8:
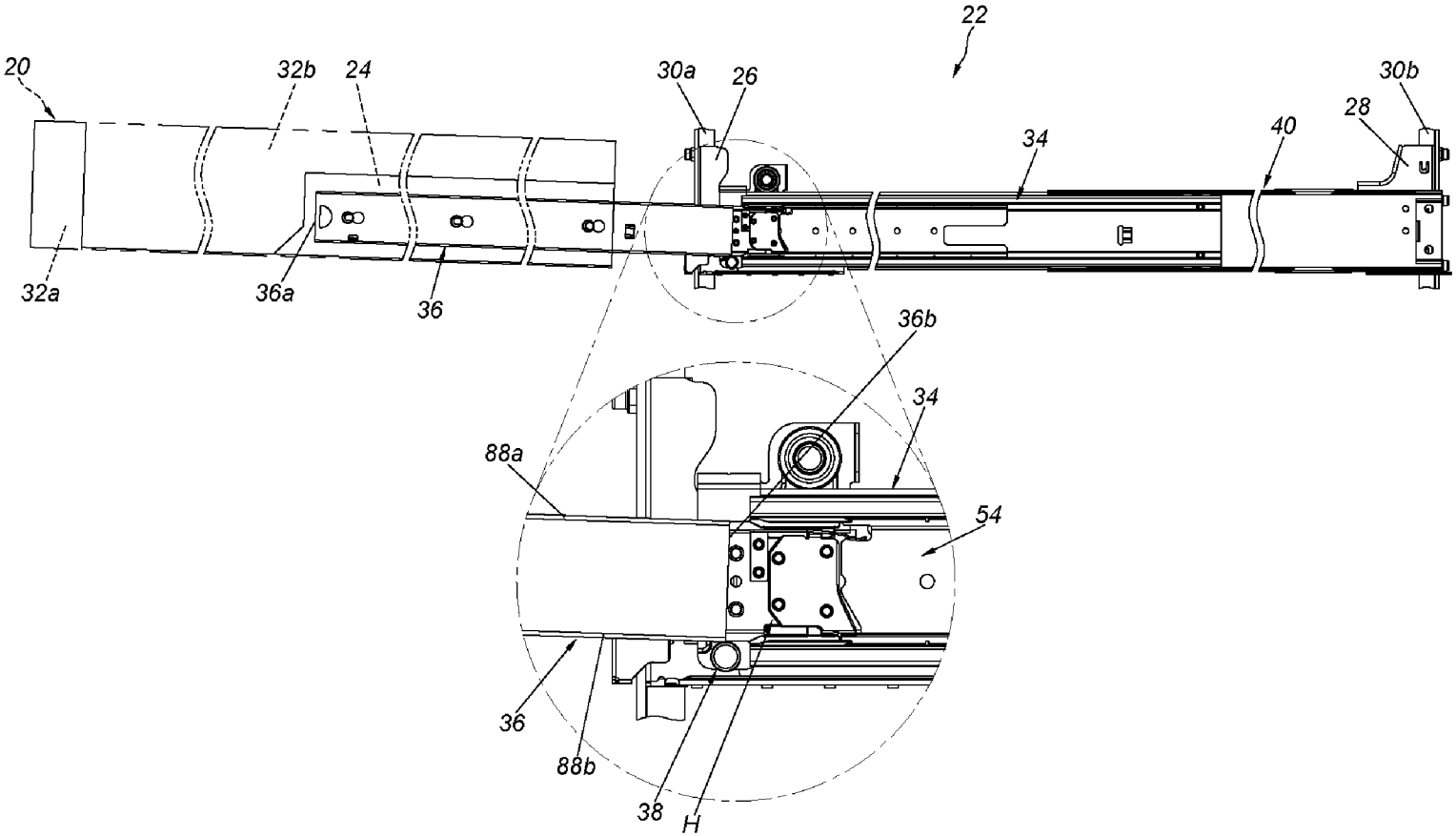
FIG. 8 is a schematic view illustrating a process of the third rail being mounted to the chassis and the second rail mounted with the object being able to be mounted to the first rail from outside the passage of the first rail according to an embodiment of the present invention.
Figure 9:
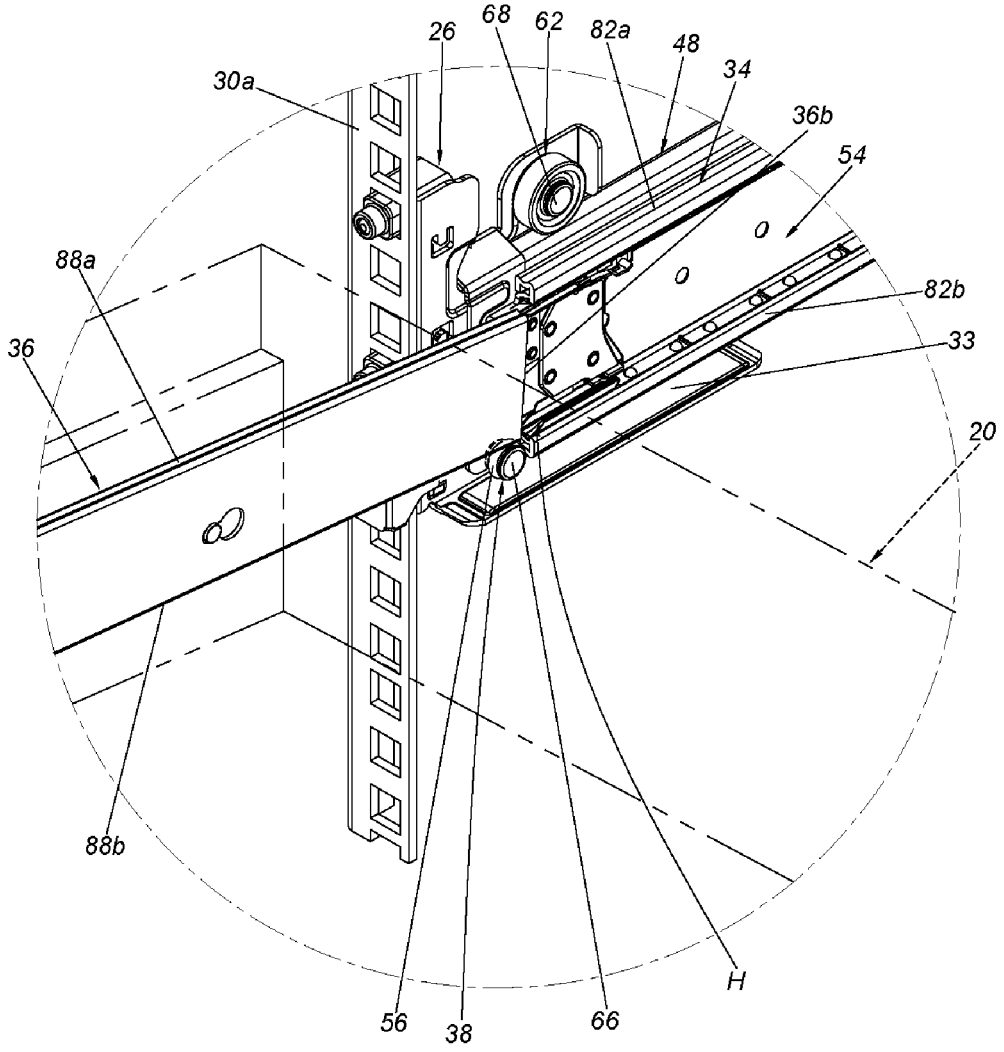
FIG. 9 is a partial perspective schematic view illustrating a process of the second rail mounted with the object being able to be mounted to the first rail from outside the passage of the first rail according to an embodiment of the present invention.
Figure 10:
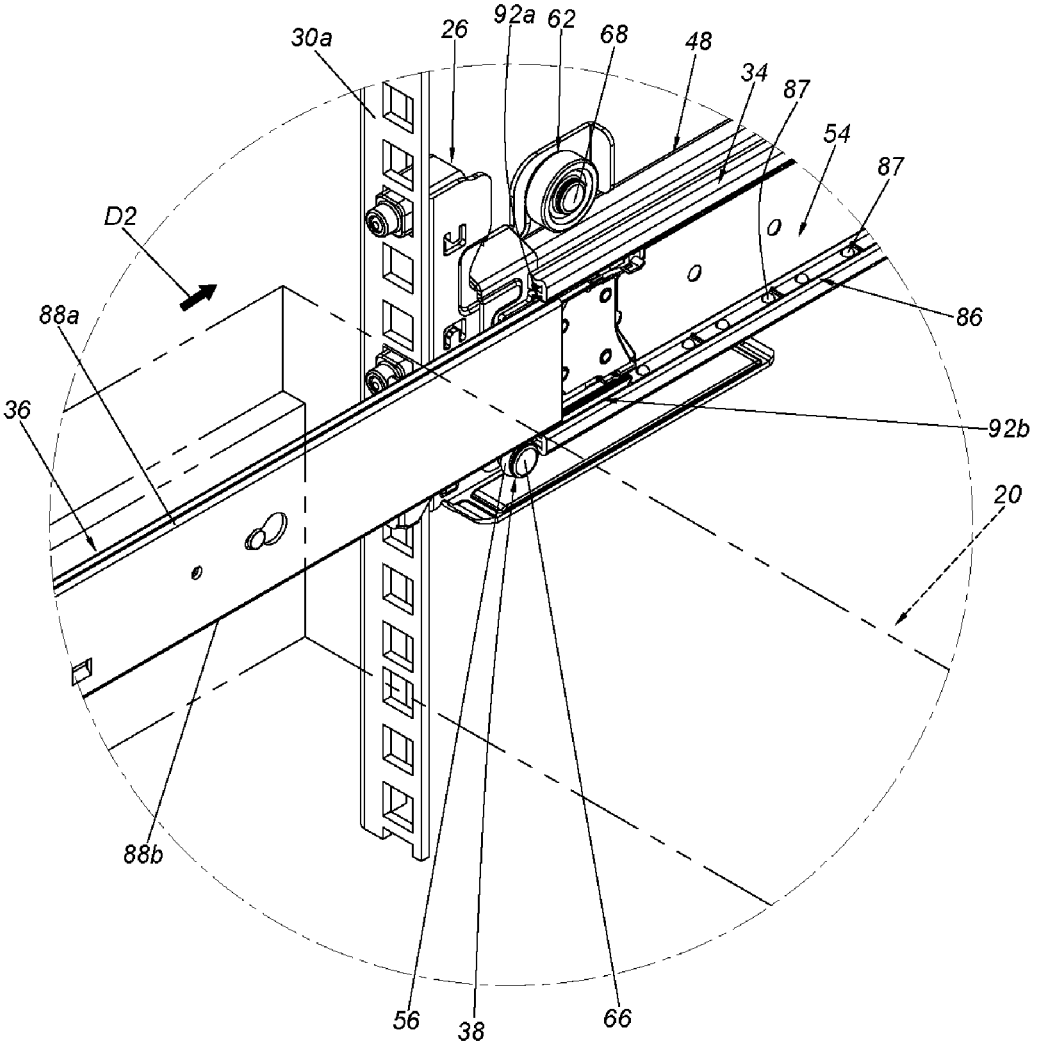
FIG. 10 is a partial perspective schematic view illustrating a process of the second rail mounted with the object being able to be guided in the passage of the first rail from outside the passage via an auxiliary member according to an embodiment of the present invention.
Figure 11:
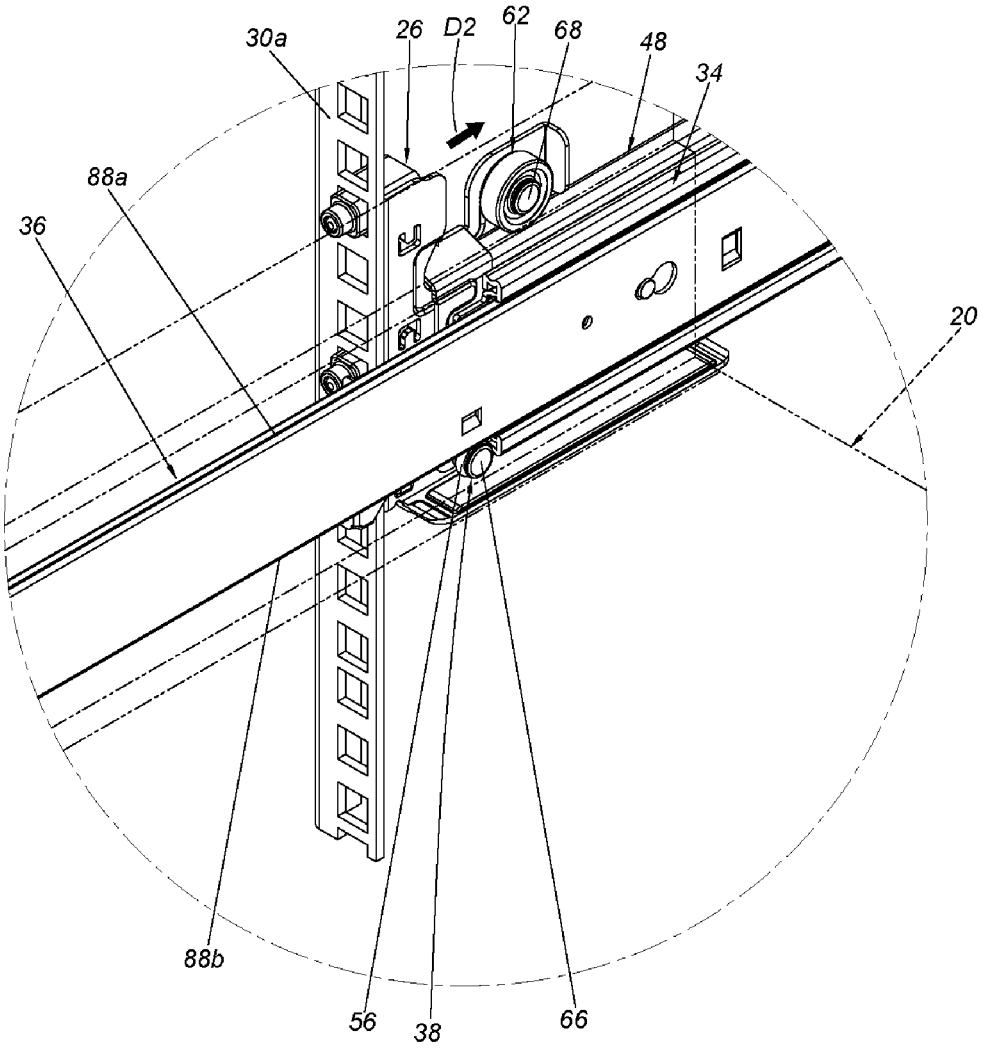
FIG. 11 is a partial perspective schematic view illustrating the second rail mounted with the object being mounted to the passage of the first rail according to an embodiment of the present invention.

Furthermore, the second rail 36 can be reinstalled to the passage 54 of the first rail 34. When the second rail 36 is reinstalled (or reinserted) from outside the passage 54 of the first rail 34 to the passage 54 of the first rail 34, (the second wall 88*b* of the second end 36*b* of) the second rail 36 can be arranged from top to bottom to be supported by the auxiliary member 38 (as shown in FIG. 8 and FIG. 9), which facilitates the second rail 36 to be aligned with the passage 54 of the first rail 34 (as shown in FIG. 10), and when the second rail 36 is moved in the retracting direction D2, the second rail 36 can be guided to insert into the passage 54 of the first rail 34 (as shown in FIG. 10 and FIG. 11) from the passage opening H of the first rail 34 through being guided by the arced contour 56 of the auxiliary member 38. It is worth mentioning that, since the auxiliary member 38 is rotatable (or pivotally rotatable) via the first shaft 66, the second rail 36 can be guided by the arced contour 56 of the auxiliary member 38 to be more easily insert into the passage 54 of the first rail 34 from the passage opening H of the first rail 34 in the retracting direction D2 (as shown in FIG. 10 and FIG. 11).

Preferably, when the second rail 36 is inserted into the passage 54 of the first rail 34, the second rail 36 (the first wall 88*a* and the second wall 88*b*) can be supported by the first blocking portion 92*a*, the second blocking portion 92*b*, and the balls 87 of the slide assisting device 86.

Therefore, the slide rail assembly 22 provided by the embodiment of the present invention includes the following features:

1. When the second rail 36 is being installed (e.g., inserted) from outside the passage 54 of the first rail 34 to inside the passage 54 of the first rail 34, the second rail 36 can be arranged from top to bottom and supported by the auxiliary member 38, which facilitates the second rail 36 to be aligned with the passage 54 of the first rail 34, and when the second rail 36 is moved in the retracting direction D2, the second rail 36 can be inserted from the passage opening H of the first rail 34 to the passage 54 of the first rail 34 through being guided by the arced contour 56 of the auxiliary member 38.

2. The supporting member 62 can roll along the first portion 70*a* of the reinforcement member 48 to reduce the frictional force generated when the first rail 34 is moved relative to the third rail 40, which facilitates to ensure the smoothness of the movement of the first rail 34 relative to the third rail 40 and allow the first rail 34 (or the second rail 36) to obtain additional supporting effect relative to the third rail 40. For the user, the afore-mentioned configuration can effectively reduce the pulling or pushing force required to be applied to the rails; that is, the user can more easily or more effortlessly complete the opening action or the closing action of the slide rail assembly 20.

3. The holding structure 74 of the connecting member 58 corresponds to one of the first portion 70*a* and the second portion 70*b* of the reinforcement member 48, which facilitates to enhance stability and structural strength of the connection member 58 being connected to the first rail 34.

Those skilled in the art will readily observe that numerous modifications and alterations of the device and method can be made while retaining the teachings of the invention. Accordingly, the above disclosure should be construed as limited only by the metes and bounds of the appended claims.

What is claimed is:

1. A slide rail assembly, comprising:

a first rail comprising a first wall, a second wall, a longitudinal wall connected between the first wall and the second wall, a first end portion, a second end portion, and a passage positioned between the first end portion and the second end portion of the first rail, the passage of the first rail comprising a passage opening;

a second rail; and an auxiliary member arranged adjacent to the passage opening of the first rail, the auxiliary member comprising an arced contour, the auxiliary member being located adjacent to the second wall of the first rail and not covered by the first wall of the first rail, the auxiliary member exceeding the first end portion of the first rail along a direction from the second end portion of the first rail to the first end portion of the first rail, and the auxiliary member being located outside the passage;

wherein the arced contour of the auxiliary member is configured for guiding the second rail to be inserted in the passage of the first rail from the passage opening of the first rail.

2. The slide rail assembly of claim 1, wherein the auxiliary member is arranged on the first rail.

3. The slide rail assembly of claim 2, wherein the auxiliary member is arranged on the first rail via a connecting member.

4. The slide rail assembly of claim 3, wherein the connecting member is connected to the first rail.

5. The slide rail assembly of claim 1, wherein the auxiliary member is a roller or a ball.

6. The slide rail assembly of claim 1, wherein the first wall, the second wall, and the longitudinal wall jointly define the passage.

7. The slide rail assembly of claim 3 further comprising a third rail, and the first rail being movably mounted between the third rail and the second rail.

8. The slide rail assembly of claim 7 further comprising a reinforcement member and a first bracket device, the reinforcement member being connected to the third rail and exceeding a first end portion of the third rail, the first bracket device being configured on the reinforcement member, and the first bracket device being configured for providing a first post for the third rail to be mounted on a rack.

9. The slide rail assembly of claim 8 further comprising a supporting member arranged on the first rail via the connecting member, and the supporting member comprising an arced contour; when the first rail is moved relative to the third rail, the first rail is in contact with the reinforcement member via the arced contour of the supporting member.

10. The slide rail assembly of claim 9, wherein the supporting member is a roller or a ball.

11. The slide rail assembly of claim 9, wherein the reinforcement member comprises a first portion, a second portion, and a longitudinal portion connected between the first portion and the second portion, the connecting member comprises a holding structure corresponding to one of the first portion and the second portion of the reinforcement member.

12. The slide rail assembly of claim 8 further comprising a second bracket device movable relative to the third rail, the second bracket device being configured for providing a second post for the third rail to be mounted on the rack.

13. The slide rail assembly of claim 6 further comprising a slide assisting device movably mounted in the passage of the first rail and a first blocking portion and a second blocking portion arranged in the passage of the first rail, and the first blocking portion and the second blocking portion are respectively adjacent to the first wall and the second wall of the first rail, so as to operate cooperatively with the slide assisting device.

14. A slide rail assembly, comprising:

a first rail comprising a first wall, a second wall, a longitudinal wall connected between the first wall and the second wall, a first end portion, a second end portion, and a passage positioned between the first end portion and the second end portion of the first rail;

a second rail; and an auxiliary member arranged adjacent to a passage opening of the first rail, the auxiliary member comprising a roller with an arced contour, the auxiliary member being located adjacent to the second wall of the first rail and not covered by the first wall of the first rail, the auxiliary member exceeding the first end portion of the first rail along a direction from the second end portion of the first rail to the first end portion of the first rail, and the auxiliary member being located outside the passage;

wherein, the auxiliary member is configured for supporting the second rail when the second rail is being mounted inside of the passage of the first rail from outside of the passage of the first rail, and the arced contour of the roller is configured for guiding the second rail to be inserted in the passage of the first rail from the passage opening of the first rail when the second rail is moved in a retracting direction.

15. The slide rail assembly of claim 14, wherein the auxiliary member is arranged on the first rail via a connecting member, and the connecting member is connected to the first rail.

16. The slide rail assembly of claim 15 further comprising a third rail, the first rail being movably mounted between the third rail and the second rail, and a reinforcement member connected to the third rail and exceeding a first end portion of the third rail.

17. The slide rail assembly of claim 16 further comprising a supporting member arranged on the first rail via the connecting member, and the supporting member comprising an arced contour; when the first rail is moved relative to the third rail, the first rail is in contact with the reinforcement member via the arced contour of the supporting member; wherein the reinforcement member comprises a first portion, a second portion, and a longitudinal portion connected between the first portion and the second portion, the connecting member comprises a holding structure corresponding to one of the first portion and the second portion.

18. A slide rail assembly, comprising:

a first rail comprising a first wall, a second wall, a longitudinal wall connected between the first wall and the second wall, a first end portion, a second end portion, and a passage positioned between the first end portion and the second end portion of the first rail;

a second rail; and an auxiliary member arranged at the first rail, the auxiliary member being one of a roller or a ball, the auxiliary member being located adjacent to the second wall of the first rail and not covered by the first wall of the first rail the auxiliary member exceeding the first end portion of the first rail along a direction from the second end portion of the first rail to the first end portion of the first rail, and the auxiliary member being located outside the passage;

wherein the auxiliary member is configured for guiding the second rail to be inserted in the passage of the first rail from a passage opening of the first rail.

19. The slide rail assembly of claim 18 further comprising a third rail and a reinforcement member, the first rail being movably mounted between the third rail and the second rail, the reinforcement member being connected to the third rail and exceeding a first end portion of the third rail.

20. The slide rail assembly of claim 19 further comprising a supporting member arranged on the first rail, and the supporting member comprising an arced contour; when the first rail is moved relative to the third rail, the first rail is in contact with the reinforcement member via the arced contour of the supporting member.

* * * * *